US006079106A

United States Patent [19]

Vallotton

[11] Patent Number: 6,079,106

[45] Date of Patent: Jun. 27, 2000

[54] KNIFE BLADE LOCKING MECHANISM

[76] Inventor: Alney K. Vallotton, 621 Fawn Ridge Dr., Oakland, Oreg. 97462

[21] Appl. No.: 09/407,012

[22] Filed: Sep. 28, 1999

[51] Int. Cl.[7] ..... B26B 1/04

[52] U.S. Cl. ..... 30/161; 30/155

[58] Field of Search ..... 30/155, 160, 161, 30/331

[56] References Cited

U.S. PATENT DOCUMENTS 4,451,982 6/1984 Collins ..... 30/161
5,095,624 3/1992 Ennis ..... 30/161
5,815,927 10/1998 Collins ..... 30/161
5,964,036 10/1999 Centofante ..... 30/161

*Primary Examiner*—Hwei-Siu Payer
*Attorney, Agent, or Firm*—Robert D. Varitz, PC

[57] ABSTRACT

A folding knife blade includes a knife case having a pair of spaced-apart sides forming a blade cavity therein, an elongate blade which is shiftable between a closed position and an open position, which is rotatably fixed between the sides of the case adjacent one end thereof; an actuator arm which is shiftable between a closed position wherein the blade is received in the case, and an open position, wherein the blade is fully extended; wherein user movement of the blade from its closed position initiates an opening action of the actuator arm, thereby causing the blade to shift to its open position and to be locked in its open position.

18 Claims, 2 Drawing Sheets

KNIFE BLADE LOCKING MECHANISM

FIELD OF THE INVENTION

This invention relates to folding knives, and specifically to a mechanism for assisting the opening of a folding knife and for locking a folding knife blade in an open position.

BACKGROUND OF THE INVENTION

Many types of folding knives are known. The folding knife was likely one of the first mechanical devices manufactured by humans. Of concern to the user of a folding knife is the requirement of opening the knife in order to use the knife for its intended purpose. While a folding knife is safer to carry than a fixed blade knife, the knife is of little use when in a folded condition.

Perhaps the best known opening assisted knife is the switch blade: a knife where the blade is spring biased to its open position and is captured in a knife case in a folded condition. Pushing a button releases the blade, allowing the knife to be ready for use. Such knifes generally lock the blade in an open condition.

Other types of spring loaded knives capture the blade longitudinally in the knife case, and the spring forces the knife blade longitudinally out of the case when desired. Again, a spring usually works directly on the blade in such a knife.

A problem with both of the aforementioned assisted-opening knives is that they are deemed illegal in many jurisdictions in the United States of America, as well as in other countries. Just what constitutes a switch blade knife is open to question in many jurisdictions, and a knife that uses a spring assist but requires some operation by the user other than simply pushing a button to release the knife blade may not be considered a switch blade, and hence, is legal in most jurisdictions in the United States of America.

SUMMARY OF THE INVENTION

A folding knife includes a knife case having a pair of spaced-apart sides forming a blade cavity therein, an elongate blade which is shiftable between a closed position and an open position; an actuator arm which is shiftable between a closed position wherein the blade is received in the case, and an open position, wherein the blade is fully extended; and wherein user movement of the blade from its closed position initiates an opening action of the actuator arm, thereby causing the blade to shift to its open position and to be locked in its open position.

An object of the invention is to provide a folding knife that has an assisted opening mechanism.

Another object of the invention is to provide a folding knife that will lock in both its open condition and closed condition.

A further object of the invention is to provide a knife that is easy to manufacture and has a minimal number of parts.

These and other objects and advantages of the invention will become more fully apparent as the description which follows is read in conjunction with the drawings.

DETAILED DESCRIPTION OF THE PREFERRED EMBODIMENT

Figure 2:
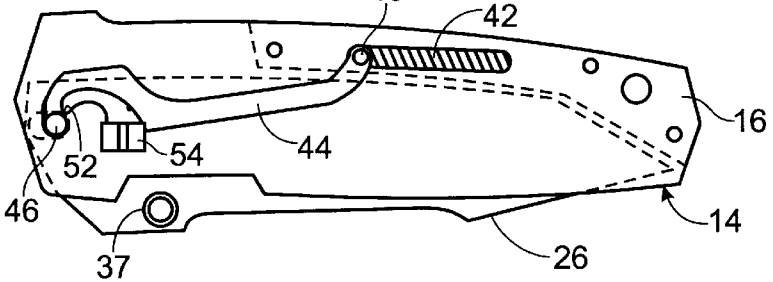
FIG. 2 is a top plan view of the knife of FIG. 1.

Turning now to the drawings, a folding knife constructed according to the invention is depicted generally at 10. For simplicity sake, the side plates of the knife are not shown, except in phantom in FIG. 2 at 12. Knife 10 includes a knife case 14 having sides 16, 18, which are held together by suitable fasteners, and form a blade cavity 20. Sides 16, 18 include a forward actuator slot 22 located at the forward end of case 14. A rear actuator slot 24 is located in side 16 adjacent the rear, or aft end, of case 14.

Figure 1:
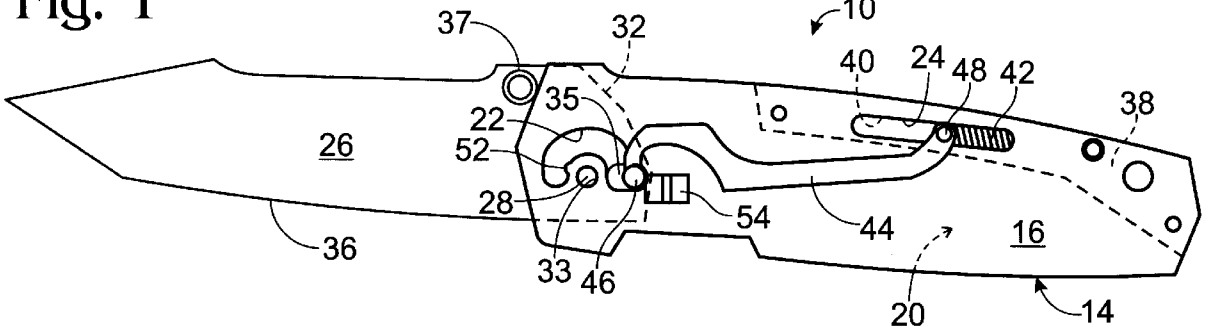
FIG. 1 is a side elevation of a knife constructed according to the invention in an open condition.
Figure 3:
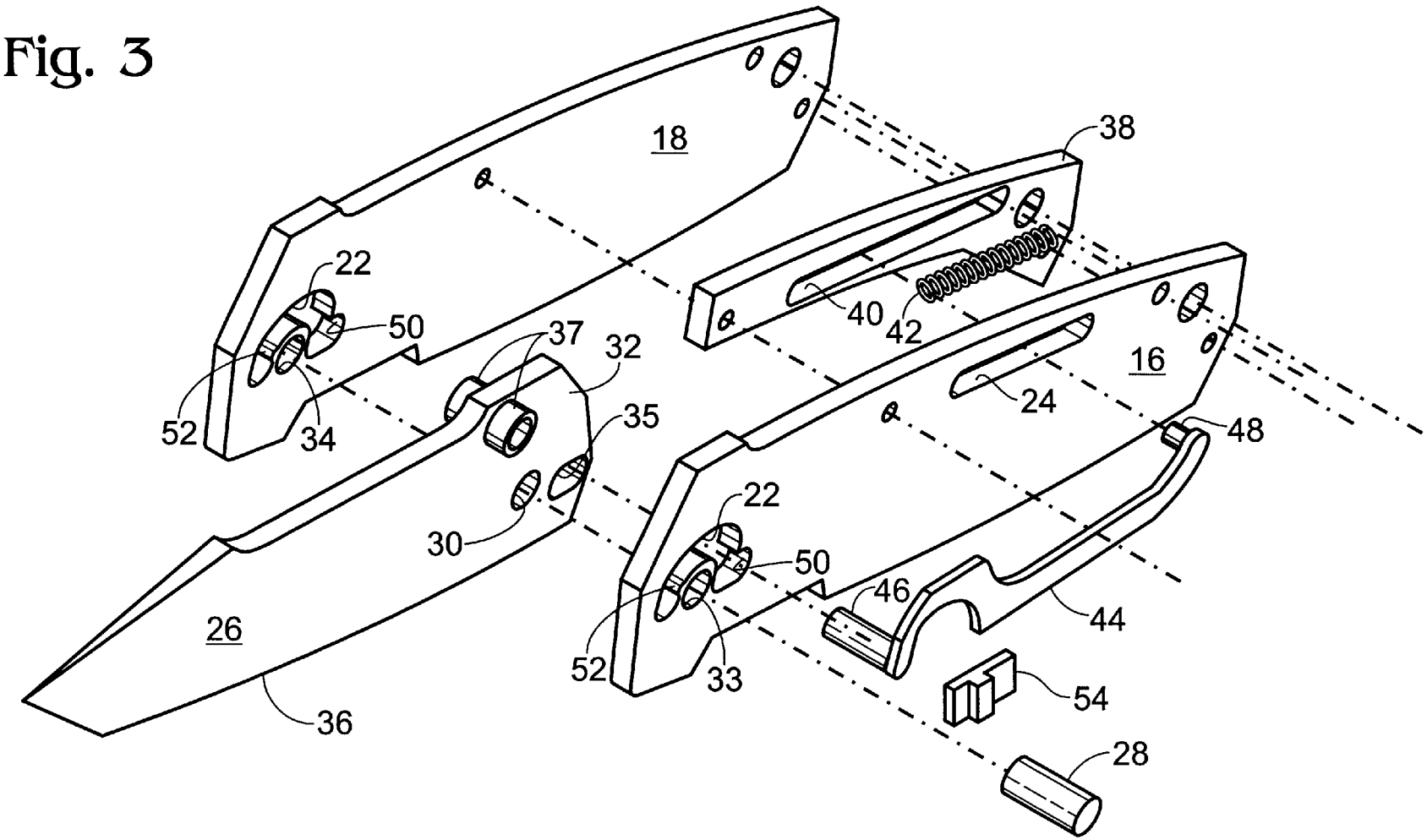
FIG. 3 is an exploded perspective view of the knife of FIG. 1.

An elongate blade 26 is rotatably fixed to case 14 by a pin 28 which extends through a bore 30 in a tang 32, located at one end of blade 26, and through similar bores 33, 34 in sides 16, 18, respectively, located adjacent one end of case 14. A locking guide 35 is formed in tang 32 immediately adjacent the rear edge of blade 26. Blade 26 is shiftable between a closed position, shown in FIG. 4 and an open position, shown in FIGS. 1–3. The blade has a cutting edge 36 along one side thereof. In the preferred embodiment, cutting edge 36 extends along the side of blade 26 that is fully received within blade cavity 20 when the blade is in its closed position. A thumb button 37 extends on either side of blade 26 and is located adjacent tang 32. Thumb button 37 provides a gripping structure for assisting a user when opening the blade, and may also provide a stop, limiting travel of blade 26 between its closed and open position.

A spring guide 38 is located adjacent the other end of case 14 and fixed between side 16, 18 thereof. Spring guide 38 includes a spring receiver 40, which, in the preferred embodiment, takes the form of an elongate slot formed in guide 38. A spring 42 is located within spring receiver 40. In the preferred embodiment, spring 42 is an expansion spring, although a compression spring may also be used.

An actuator arm 44 extends between rear actuator slot 24 and forward actuator slot 22, and has a front pin 46 located at the forward end thereof and a rear pin 48 located at the rear thereof. Front pin 46 projects through forward actuator slot 22 and into locking guide 35. Rear pin 48 projects through rear actuator slot 24 and into spring receiver 40, where it is positioned ahead of spring 42 in spring receiver 40. Spring 42 urges actuator arm rearward in this configuration. Actuator arm is shiftable between a closed position, shown in FIG. 4, wherein blade 26 is received in blade cavity 20, and an open position, shown in FIGS. 1 and 2, wherein blade 26 is in its opened position. When an expansion spring is used as spring 42, the spring may be located either fore or aft of rear pin 48. When spring 42 is a compression spring, it is located forward of rear pin 48.

Front pin 46 extends through forward actuator slots 22 is sides 16, 18, and in locking guide 35. Pin 46 rides in forward actuator slots 22, which have a semicircular configuration, each with an elongate slot 50 formed normal to the curve of slot 22, and each of which also has a locking cam 52, located adjacent the other end of slot 22. When blade 26 is in its closed position, front pin 46 is captured between locking cams 52 and the other ends of actuator slots 22. Locking cam 52 is constructed and arranged to require movement of blade 26 through an arc having a predetermined angle of rotation before front pin 46 rides over locking cam 52. In the preferred embodiment, this angle is between five and nine degrees, with seven degrees being the preferred angle. An actuator arm release 54 is operable to shift actuator arm 44 forward out of slot 50, so that blade 26 may be closed.

Figure 4:
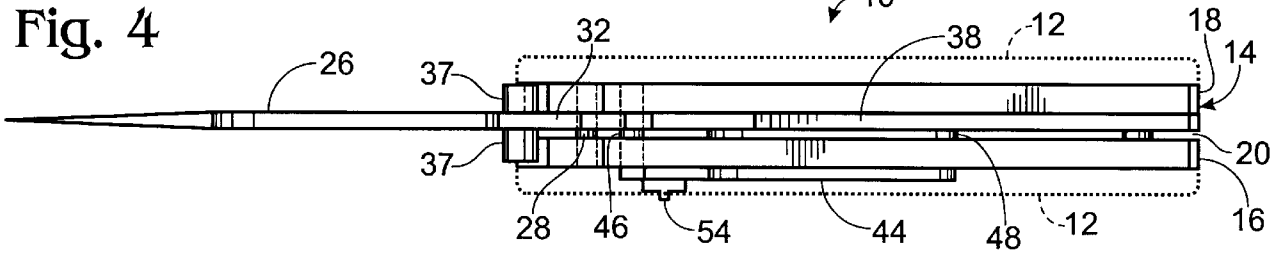
FIG. 4 is a side elevation of the knife of FIG. 1 in a closed condition.

Referring now to FIG. 4, when a user desires to open blade 26, the user moves blade 26 out of its closed position with thumb button 37. As the blade shifts beyond a predetermined angle, front pin 46 rides over locking cams 52, spring 42 pulls actuator arm 44 rearward, thus swinging blade 26 about pin 28 by the action of front pin 46 in locking guide 35. Such movement is referred to herein as an opening action. When the blade is fully opened, front pin 46 lodges in elongate slots 50, locking blade 26 in its open position. As previously noted, thumb button 37 may also serve as a stop for blade 26 in its opened position. When open, blade 26 is held in position by front pin 46 extending through forward actuator slots 22 and locking guide 35.

To close knife 10, actuator arm release 54 is shifted towards blade 26, thereby pushing actuator arm 44 forward, and freeing front pin 46 from elongate slots 50. This allows blade 26 to rotate about its axis on pin 28 and into blade cavity 20. When blade 26 is fully closed, front pin 46 rides over locking cams 52, and holds the blade in its closed position.

Thus, a knife blade locking mechanism has been disclosed which is operable to urge a blade into an open position from a closed position when the blade is moved beyond a predetermined angle, and is also operable to lock the folding blade in both its open and closed position. Although a preferred embodiment of the invention has been disclosed, it will be appreciated that further variations and modifications may be made thereto without departing from the scope of the invention as defined in the appended claims.

I claim:

1. A knife blade locking mechanism for locking a folding knife blade, comprising:

a knife case having a pair of spaced-apart sides forming a blade cavity therein, including a forward actuator slot and a rear actuator slot therein;

an elongate blade which is shiftable between a closed position and an open position, said blade having a cutting edge along at least one side thereof and a tang at one end thereof, wherein said tang is rotatably fixed between said sides of said case adjacent one end thereof and wherein said tang includes a locking guide therein;

a spring guide located adjacent the other end of said case and fixed between the sides thereof, said spring guide having a spring receiver therein;

a spring located in said spring receiver and substantially captured between said sides of said case;

an actuator arm having extending between said forward actuator slot in said case and said spring receiver, having a front pin received in said forward actuator slot and in said locking guide, and having a rear pin received in said spring receiver, said actuator arm is shiftable between a closed position wherein said blade is received in said case, and an open position, wherein said blade is fully extended;

wherein user movement of said blade from its closed position initiates an opening action of said actuator arm, thereby causing said blade to shift to its open position and to be locked in said open position.

2. The folding knife of claim 1 wherein said blade includes a thumb button located adjacent said tang providing a gripping structure for a user.

3. The folding knife of claim 1 wherein said blade includes a thumb button located adjacent said tang providing a stop for said blade in its open position.

4. The folding knife of claim 1 which further includes an actuator arm release to release said actuator arm from its open position.

5. The folding knife of claim 1 wherein said spring is a compression spring and is located forward of said rear pin in said spring receiver.

6. The folding knife of claim 1 wherein said spring is an expansion spring and is located fore or aft of said rear pin in said spring receiver.

7. A knife blade locking mechanism for locking a folding knife blade, comprising:

a knife case having a pair of spaced-apart sides forming a blade cavity therein, including a forward actuator slot and a rear actuator slot therein;

an elongate blade which is shiftable between a closed position and an open position, said blade having a cutting edge along at least one side thereof and a tang at one end thereof, wherein said tang is rotatably fixed between said sides of said case adjacent one end thereof and wherein said tang includes a locking guide;

a spring guide located adjacent the other end of said case and fixed between the sides thereof, said spring guide having a spring receiver therein;

a spring located in said spring receiver and substantially captured between said sides of said case;

an actuator arm extending between said forward actuator slot in said case and said spring receiver, having a front pin received in said forward actuator slot and in said locking guide, and having a rear pin received in said spring receiver, said actuator arm is shiftable between a closed position wherein said blade is received in said case and wherein said front pin is captured by a locking cam, in said forward actuator slot and an open position, wherein said blade is fully extended;

wherein user movement of said blade out of said case beyond a predetermined angle initiates an opening action of said actuator arm, thereby causing said blade to shift to its open position and to be locked in said open position.

8. The folding knife of claim 7 wherein said blade includes a thumb button located adjacent said tang providing a gripping structure for a user.

9. The folding knife of claim 7 wherein said blade includes a thumb button located adjacent said tang providing a stop for said blade in its open position.

10. The folding knife of claim 7 which further includes an actuator arm release to release said actuator arm from its open position.

11. The folding knife of claim 7 wherein said spring is a compression spring and is located forward of said rear pin in said spring receiver.

12. The folding knife of claim 7 wherein said spring is an expansion spring and is located fore or aft of said rear pin in said spring receiver.

13. A knife blade locking mechanism for locking a folding knife blade, comprising:

a knife case having a pair of spaced-apart sides forming a blade cavity therein, including a forward actuator slot and a rear actuator slot therein;

an elongate blade which is shiftable between a closed position and an open position, said blade having a cutting edge along at least one side thereof and a tang at one end thereof, wherein said tang is rotatably fixed between said sides of said case adjacent one end thereof and wherein said tang includes a locking guide therein;

a spring guide located adjacent the other end of said case and fixed between the sides thereof, said spring guide having a spring receiver therein;

a spring located in said spring receiver and substantially captured between said sides of said case;

an actuator arm extending between said forward actuator slot in said case and said spring receiver, having a front pin received in said forward actuator slot and in said locking guide, and having a rear pin received in said spring receiver, said actuator arm is shiftable between a closed position wherein said blade is received in said case, and an open position. wherein said blade is fully extended; and an actuator arm release to release said actuator arm from its open position;

wherein user movement of said blade out of said case beyond a predetermined angle initiates an opening action of said actuator arm, thereby causing said blade to shift to its open position and to be locked in said open position.

14. The folding knife of claim 13 wherein said blade includes a thumb button located adjacent said tang providing a gripping structure for a user.

15. The folding knife of claim 13 wherein said blade includes a thumb button located adjacent said tang providing a stop for said blade in its open position.

16. The folding knife of claim 13 wherein said spring is a compression spring and is located forward of said rear pin in said spring receiver.

17. The folding knife of claim 13 wherein said spring is an expansion spring and is located fore or aft of said rear pin in said spring receiver.

18. The folding knife of claim 13 wherein said predetermined angle is between about five degrees and nine degrees.

* * * * *